United States Patent [19]

White

[11] Patent Number: 4,526,803

[45] Date of Patent: Jul. 2, 1985

[54] TRANSPARENTIZING

[75] Inventor: Leonard A. White, Gurnee, Ill.

[73] Assignee: Baxter Travenol Laboratories, Inc., Deerfield, Ill.

[21] Appl. No.: 506,033

[22] Filed: Jun. 20, 1983

[51] Int. Cl.[3] ..... B05D 1/04; B05B 5/00

[52] U.S. Cl. ..... 427/14.1; 427/27; 427/161; 427/210; 428/918; 118/59; 118/101; 118/102; 118/624; 118/644

[58] Field of Search ..... 427/161, 27, 14.1, 32, 427/210, 195, 389.9, 391; 428/918; 118/59, 624, 644, 101, 102

[56] References Cited

U.S. PATENT DOCUMENTS

| | | | |
|---|---|---|---|
| 3,267,840 | 8/1966 | Honma et al. | 101/1 |
| 3,513,010 | 5/1970 | Notley | 117/11 |
| 3,549,403 | 12/1970 | Williams, Jr. et al. | 427/32 |
| 3,692,606 | 9/1972 | Miller et al. | 156/151 |
| 3,788,845 | 1/1974 | Osawa et al. | 96/1 R |
| 3,793,016 | 2/1974 | Eichorn | 118/637 |
| 3,813,261 | 5/1974 | Maller | 427/391 |
| 3,865,610 | 2/1975 | Goodridge et al. | 118/624 |
| 3,974,302 | 8/1976 | Croop et al. | 427/21 |
| 4,076,895 | 2/1978 | Theno | 428/516 |
| 4,172,418 | 10/1979 | Durand | 101/194 |
| 4,237,185 | 12/1980 | Lombardi et al. | 428/337 |
| 4,257,843 | 3/1981 | Wanatabe et al. | 162/146 |
| 4,299,880 | 11/1981 | Arens | 427/146 |

OTHER PUBLICATIONS

The 1982 Packaging Encyclopedia, "Laminations and Composite Structures", J. A. Albright, pp. 98–102.

*Primary Examiner*—Norman Morgenstern
*Assistant Examiner*—Ken Jaconetty
*Attorney, Agent, or Firm*—Bradford R. L. Price; John P. Kirby, Jr.; Robert P. Barrett

[57] ABSTRACT

A generally non-transparent substrate is rendered substantially transparent, for example at a particular location or locations thereon, by electrostatically depositing finely divided transparentizing particles onto the substrate and then heating those particles to facilitate their flow into the intersticies of the substrate. The transparentizing particles have an optical refractive index that is substantially the same as that of the substrate, and these transparentizing particles have a melting point greater than that encountered during handling and storage and less than the temperature at which the substrate would be damaged.

11 Claims, 8 Drawing Figures

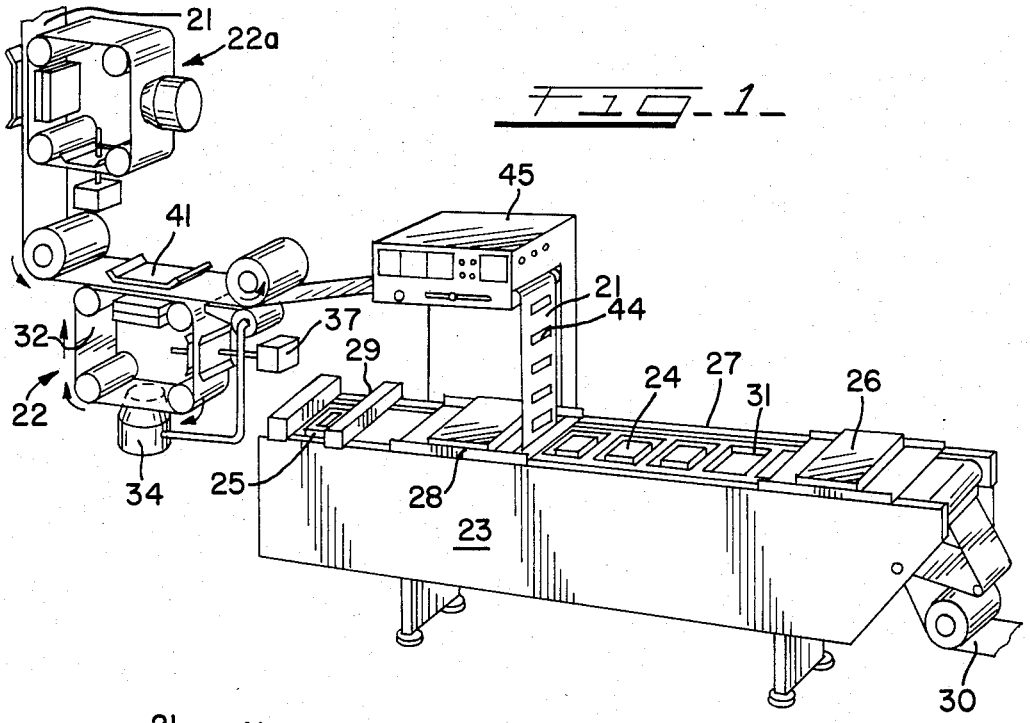
FIG. 1
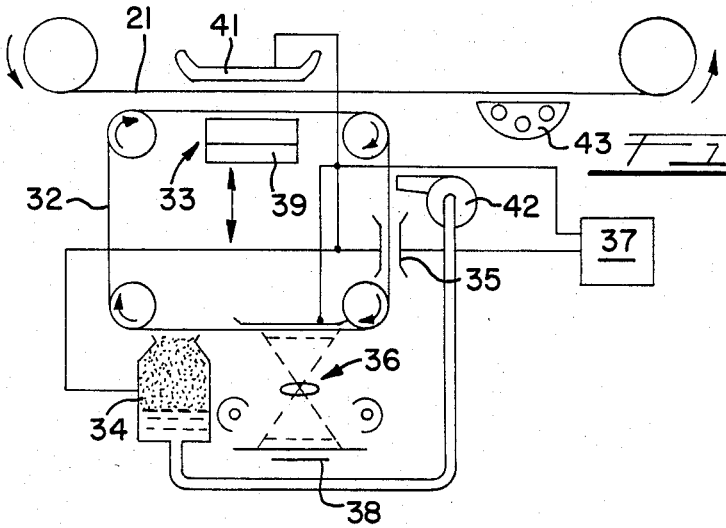
FIG. 2
FIG. 4
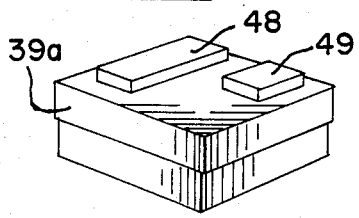
FIG. 3
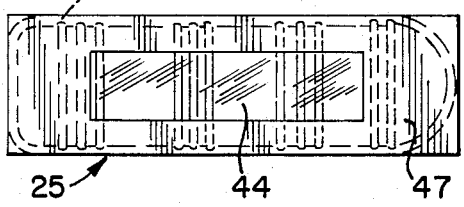

FIG. 5
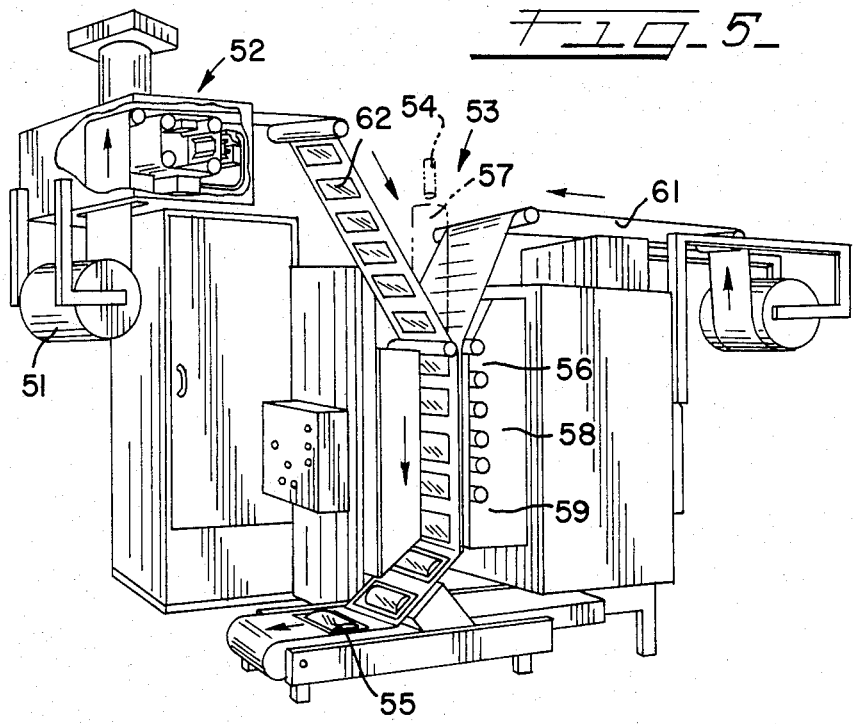
FIG. 7
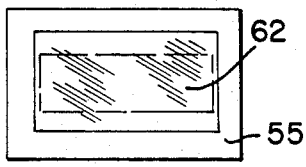
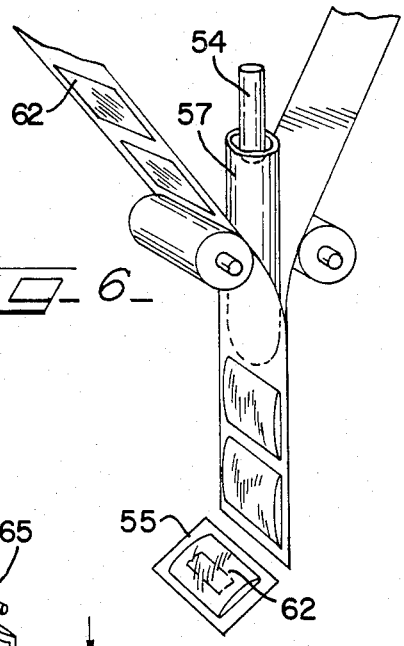
FIG. 6
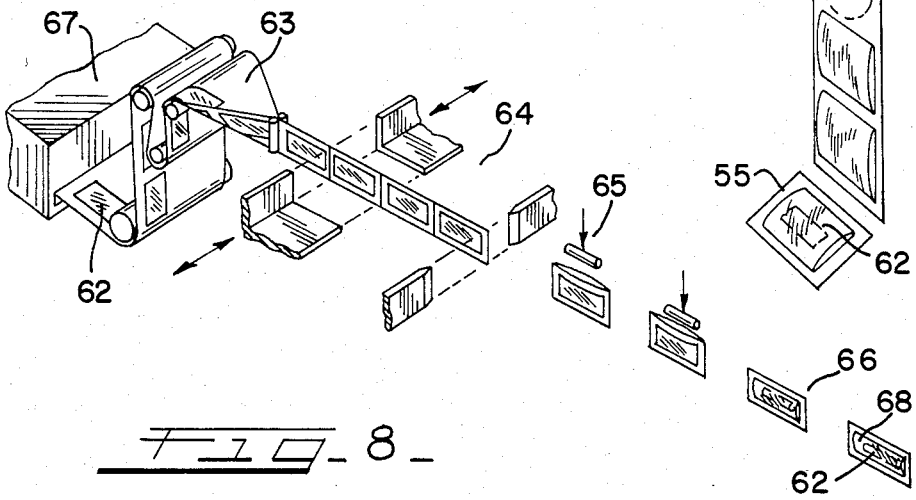
FIG. 8

TRANSPARENTIZING

DESCRIPTION

This invention generally relates to the transparentizing of a substrate, more particularly to a method, product and apparatus wherein finely divided electrostatically chargeable transparentizing particles are electrostatically deposited onto a generally non-transparent substrate, such as a cellulosic material, and the particles are heated until they flow into the intersticies of the substrate in order to thereby transparentize the substrate at the location upon which the transparentizing particles had been electrostatically deposited.

Transparentizing is a technique by which a generally non-transparent substrate, such as a cellulosic web, is rendered generally transparent by treatment with transparentizing agents. Conventional transparentizing which is carried out in manufacturing tracing paper, onionskin products, and the like typically involves saturating a cellulosic stock with a solvent-containing or a solvent-based resin or the like in order to impregnate the stock with the resin. With such a procedure, it is generally impractical, if not impossible in a commercial-scale operation, to transparentize only a selected area of a web of stock material, since the entire web is treated at once. Solventless, curable resin systems have been proposed, but these, too, contemplate a full immersion of the stock within the transparentizing resin.

If, in a solvent-based or solventless transparentizing system, it is desired to transparentize only a portion of a substrate, for example in order to provide a transparent "window" within the substrate for subsequent use in preparing a package having a transparent window, any such selective transparentizing would be extremely expensive and awkward because of the need to contain the transparentizing material to the confines of the desired window area and shape.

It is often required that a package be transparent or have a transparent portion for inspection, identification or the like. One manner of accomplishing this is to utilize a transparent material as one of the package members or panels. In certain circumstances, the use of a transparent material in a packaging application may be undesirable due to reasons such as material costs, radiation stability, formability, availability, porosity requirements, and the like. Porosity is an important factor when the package is to be subjected to sterilization techniques. Also, it is often desirable to have a package member or panel that combines a generally opaque portion, in order to effect imprinting and the like, with a generally transparent area through which the contents of the package can be seen.

One approach in this regard is to provide a transparent window within a generally opaque package panel or lid by a traditional procedure using multiple components, one transparent and the other generally opaque. For example, an opening can be cut out of a generally opaque material, and a generally transparent section is laid over the opening and glued or otherwise adhered to the generally opaque substrate. Such a multiple-component approach is relatively expensive, and it also tends to be generally undesirable for use in applications where sterilitiy or cleanliness is required, such as in packaging medical implements, articles or devices.

Accordingly, it would be particularly useful if it were possible to provide a substrate having a generally transparent portion, which portion can be varied as to its location, size and shape in order to meet a particular need, especially in conjunction with providing a package having a generally transparent window therewithin, all while avoiding the need for a multi-component member or panel wherein a transparent substrate is joined to a separate generally opaque substrate.

The present invention achieves these objectives by transparentizing as much or as little of a substrate, in substantially any configuration and at virtually any location on the substrate, as is desired in order to meet a particular packaging requirement. This is accomplished by electrostatically depositing a finely divided transparentizing powder at the needed location on a generally opaque substrate and in the pattern desired for the transparent window or the like. The electrostatically deposited transparentizing powder is heated to the extent that the powder flows into the intersticies of the substrate, after which the substrate is allowed to cool. The transparentizing powder is one having a moderate melting point and an optical refractive index that is substantially the same as that of the substrate.

It is accordingly a general object of this invention to provide improved transparentizing.

Another object of the present invention is to provide an improved method, product and apparatus which transparentize by using electrostatic deposition techniques.

Another object of the present invention is to utilize electrostatic particle deposition techniques in conjunction with forming a transparent window or the like within a generally opaque packaging panel.

Another object of this invention is to provide an improved apparatus for packaging products which includes in-line transparentizing of a selected area of the package.

Another object of this invention is to provide an improved method, article and apparatus for providing a generally transparent window that is an integral portion of the panel within which it is located.

These and other objects of the present invention will be apparent from the following detailed description and drawings, wherein:

FIG. 1 is a perspective view illustrating an embodiment of the method and apparatus in accordance with the present invention;

FIG. 2 is an enlarged elevational view of an electrostatic transparentizing assembly illustrated in FIG. 1;

FIG. 3 is a plan view of an article having a lid with a generally transparent window in accordance with this invention;

FIG. 4 is a perspective view of an optional transparentizing die for use in one embodiment according to this invention;

FIG. 5 is a perspective view of another embodiment of the method, apparatus and product in accordance with this invention;

FIG. 6 is an enlarged, detail perspective view of the filling station of the embodiment illustrated in FIG. 5;

FIG. 7 is an elevational view of an article prepared in accordance with the embodiment of FIG. 5; and FIG. 8 is a schematic illustration of a further embodiment of the method, article and apparatus according to this invention.

With reference to the embodiment illustrated in FIG. 1, a generally opaque feed stock 21 passes through an electrostatic transparentizing assembly, generally designated as 22, and through an assembly, generally designated as 23, for forming, filling and sealing a product 24 in order to form a finished package or article 25. Assembly 23 includes a forming station 26, a filling station 27, a closing station 28, and a sealing station 29, each of which is of known construction to join the feed stock 21 with a package stock 30, which is formed as container panels 31, into a plurality of articles 25 having one or more products 24 sealed therewithin.

Referring more particularly to the electrostatic transparentizing assembly 22, such includes components for electrostatically depositing transparentizing powder for transferring same to the feed stock 21, and for heating the powder into the feed stock 21. A typical electrostatic transfer assembly includes a reusable continuous loop 32, a transfer assembly, generally designated as 33, a deposition assembly 34, an electrostatic charging unit 35, a lens and light system 36, and a high voltage power supply 37.

The desired transparent area or pattern is deposited in this particular embodiment by charging the continuous loop 32 through use of the electrostatic charging unit 35, followed by imparting the desired pattern thereto by the operation of the lens and light system 36 in conjunction with an original pattern 38 that is sized, shaped and positioned to provide the desired transparent area in the feed stock 21. The charge pattern is then subjected to coating at the deposition station 34 in order to form a transfer coating, corresponding to the original pattern 38. This patterned transfer coating is subsequently transferred to the feed stock 21 by the transfer assembly 33, which in this illustrated embodiment includes a transfer plate 39 and a charged platten 41. A suitable removal assembly 42, such as a vacuum system, can be provided to remove unused transparentizing particles from the reusable continuous loop 32 and, if desired, return same to the deposition assembly 34.

In some embodiments, the required heating may be included within the transfer assembly 33, such as by heating the plate 39, this heat being adequate to melt the transparentizing particles after they have been transferred to the feed stock 21. A heating assembly 43 may assist or replace the heating accomplished by the transfer assembly 33. Such heating assembly 43 may take the form of heat lamps as generally illustrated in FIG. 2, or of hot rollers or heated nip rollers, a fusing tunnel, or the like. Heating may be accompanied by the application of pressure, for example, by the transfer plate 39 or by other suitable means. The effectiveness by which the molten transparentizing material is impregnated into the feed stock 21 at any given temperature is a function of the time of treatment and the pressure conditions provided by the apparatus, as well as by the amount of transparentizing powder applied at any given area and the absorbing capabilities of the molten transparentizing agent with respect to the substrate being transparentized.

One variation on this aspect of the invention is the inclusion of a further electrostatic transparentizing assembly 22*a*, which accomplishes its transparentizing function from one side of the web 21, while the other electrostatic transparentizing assembly 22 carries out its transparentizing function from the other side of the web 21 at substantially the same location that the electrostatic transparentizing assembly 22*a* had treated the feed stock 21. This variation is particularly useful when the substrate being transparentized is relatively thick.

Generally transparent areas, such as windows 44, are thus imparted to the feed stock 21, and this windowed feed stock passes through a suitable feed station 45. Station 45 can, if desired, add printed information to the feed stock 21. It can also include known mechanisms for providing adequate dwell of the feed stock 21 in association with suitable movement mechanisms to insure that the window 44 is accurately indexed over the formed container panel 31 to thereby form an accurately aligned finished package or article 25. The finished package or article 25 illustrated in FIG. 3 includes a semi-rigid or rigid bubble portion 46 onto which is sealed a lid 47 having the window 44, which lid 47 had been severed from the feed stock 21. The window 44 and the lid 47 are a single, unitary and integral sheet of stock.

With reference to the embodiment illustrated in FIG. 4, such represents a stamping plate 39*a* which can replace the transfer plate 39 in FIG. 2. The stamping plate 39*a* includes raised portions or die surfaces which are provided to define the shape of the transparentized area to be formed within the feed stock 21. One or more separate areas can be included, such as the surfaces 48 and 49. With more particular reference to the structure illustrated in FIG. 4, two separate transparent windows will be formed within the feed stock 21, which windows are shaped, sized and positioned in accordance with the upper surface of the raised portions 48 and 49.

In this particular embodiment, it is possible to omit the lens and light system 36 of the electrostatic transparentizing assembly 22, 22*a*. If desired, the deposition assembly 34 deposits the transparentizing particles throughout substantially the entire width of the continuous loop 32 in order to thereby electrostatically coat the reusable continuous loop 32 with the transparentizing particles. The desired window pattern, which corresponds to the shape of the working surface of the stamping plate 39*a*, for example the raised portions 48 and 49, is then imparted to the feed stock 21 when the stamping plate 39*a* transfers the electrostatic particles from the continuous loop 32 and onto the feed stock 21 at the transfer assembly 33.

With more particular reference to the electrostatic deposition assemblies suitable for use in connection with this invention, the electrostatic charging and discharging thereof can be arranged such that the electrostatically chargeable particles or the like are deposited on the reusable continuous loop 32 by a system that either charges or discharges the loop 32 by the application of actinic energy originating within the power supply 37. The loop 32 can be first electrostatically charged and then discharged to form the electrostatic charge thereon. Alternatively, the reusable continuous loop 32 can be selectively electrostatically charged to a configuration that is consistent with the original pattern 38. Whichever mechanism is used, the electrostatically chargeable transparentizing particles that are deposited by the deposition station 34 are electrostatically treated so that they adhere to the electrostatic charge applied to the loop 32, which is typically a photoconductor. By this electrostatic procedure, the electrostatically chargeable transparentizing particles and the electrostatic charge on the loop 32 are of opposite polarity, or one of them is substantially uncharged while the other holds a high voltage charge.

Concerning the embodiment illustrated in FIGS. 5 and 6, a feed stock 51 passes through an electrostatic transparentizing assembly, generally designated as 52, and through a forming and filling assembly, generally designated as 53. Assembly 53 is for forming a pouch, filling product 54 thereinto and sealing the pouch in order to form a finished pouch or article 55. Assembly 53 includes a side and bottom sealing station 56, a filling station 57, a closing or final sealing station 58, and a cutting or separating station 59, each of which is of generally known construction to join the feed stock 51 with a pouch stock 61 into a plurality of sealed and separated pouches or articles 55 having the product 54 sealed therewithin.

The electrostatic transparentizing assembly 52 may be of a structure as discussed in accordance with the embodiments of FIGS. 1 through 4. Electrostatic transparentizing assembly 52 forms transparent areas or windows 62 into the feed stock 51 in substantially the same manner as that of the FIGS. 1 through 4 embodiments. The finished pouch or article 55, further illustrated in FIG. 7, is a two-sided pouch having the transparent windows 62 thereon and having product 54 sealed therewithin.

FIG. 8 illustrates an embodiment similar to that of FIGS. 5 and 6, except it includes a feed stock 63 that is oriented in a generally horizontal direction and that is folded upon itself at a forming station 64, is filled at a filling station 65, and is sealed at a sealing station 66 in order to provide an integral finished pouch or article 68 having an integral transparent window 62. This apparatus includes an electrostatic transparentizing assembly 67, which is of a type generally discussed in conjunction with the embodiments of FIGS. 1 through 4.

The transparentizing particles that are used in conjunction with this invention are finely divided electrostatically chargeable particles that have a moderate melting point and that have an optical refractive index close to that of the substrate or feed stock into which it is absorbed. These particles must be capable, when in their molten state, of flowing into the intersticies or pores of the feed stock and of resolidifying therewithin upon cooling. The particles must also substantially remain in a generally solid state with such intersticies or pores during the time that the packages or articles including same are handled and stored.

Because these particles have a refractive index similar to that of the feed stock within which they are thus impregnated, the feed stock fibers are rendered transparent by virtue of their close physical proximity to the fused transparentizing powder. Typically, the transparentizing powder is a material that will, once it is melted and cooled, be substantially transparent. Most suitable transparentizing powders will have a refractive index (n) of between about 1.3 and 1.7 after the powder has been melted and cooled.

Regarding the moderate melting temperature exhibited by these transparentizing particles, the melting point should be below the scorching or softening temperature of the feed stock being transparentized, and it should be above the handling and storage temperature of the article being produced in order to avoid release of the transparentizing material while the article is being handled, which could give the transparentized window a greasy, unstable appearance. Typical cellulosic feed stock has a charring temperature on the order of 500° F., and the transparentizing powder will, for use in conjunction with most cellulosic articles, have a melting temperature below this temperature. Typical handling and storage could involve temperatures on the order of about 100° F. A representative melting temperature range for transparentizing particles in accordance with this invention would be on the order of between about 120° F. and 470° F., although such will of necessity vary with the storage and handling requirements for the article and with the charring or softening temperature of the particular feed stock.

Another variable in this regard is the extent of any pressure applied during the transparentizing step, and also the length of time that the step is carried out. Generally speaking, a higher pressure and a longer treatment time will reduce the temperature required to effectively transparentize the area desired.

Suitable transparentizing powders include polymers, waxes, naturally occurring resins and the like, such as medium density polyolefin powders, for example polyethylene, relatively high melting point paraffin waxes, polyolefin waxes such as the polyethylene waxes, microcrystalline wax, and naturally occurring resins such as shellac. Any such materials can be formulated, if necessary, in order to exhibit an optical refractive index that is as close as possible to the refractive index of the feed stock being transparentized. A difference of not more than about $\pm 0.02$ between the respective refractive indices (n) of the transparentizing powder and the feed stock is considered to be an excellent match that will usually result in a relatively high level of transparency. Greater differences also can be useful, depending upon the particular transparentizing powder and feed stock and upon the degree of transparency needed.

The transparentizing material should be readily susceptible of being powdered and being suspended in a fluidized bed or magnetic brush. Particles in accordance with this invention are typically dielectric in nature, possessing dielectric properties to the extent that they are not totally conductive and can hold a charge.

Suitable substrates or feed stocks should have adequate porosity to readily accept the molten transparentizing material therewithin. While they will typically be in the nature of a fibrous non-woven product, certain woven products could be acceptable. Preferred substrate materials are of the cellulosic type including paper such as surgical Kraft paper or of the polymeric type such as non-wòven polymer film material.

It will be understood that the embodiments of the present invention which have been described are merely illustrative of a few of the applications of the principals of the present invention. Numerous modifications may be made by those skilled in the art without departing from the true spirit and scope of the invention.

I claim:

1. A method for electrostatically transparentizing a portion of a substrate, comprising:

selecting finely divided, electrostatically chargeable particles of a material having transparentizing characteristics for a preselected substrate;

electrostatically depositing said finely divided transparentizing particles onto a predetermined area of the substrate;

heating the transparentizing particles to form a molten transparentizing material at the predetermined area; and transparentizing the substrate at the predetermined area by flowing the molten transparentizing material into the substrate at the predetermined area and allowing the material to solidify therein to form a substrate having a transparentized area and an opaque area.

2. The method of claim 1, wherein said selecting step includes choosing the transparentizing material to have a refractive index approximately the same as that of the substrate and to have a melting temperature that is greater than ambient temperature and less than a temperature at which the substrate is damaged.

3. The method of claim 1, wherein said electrostatically depositing step includes electrostatically depositing the transparentizing particles onto a section of an endless surface having a reusable continuous loop, contacting the substrate with said section of the reusable continuous loop, and transferring at least some of the transparentizing particles onto the substrate.

4. The method of claim 1, further including forming the substrate having the transparentized area into a container having a transparentized area.

5. The method of claim 1, wherein said electrostatic depositing step includes electrostatically depositing the transparentizing particles in a pattern onto an endless surface, and wherein said transparentizing step includes applying pressure to the pattern.

6. The method of claim 1, wherein said electrostatic depositing step includes depositing the transparentizing particles generally uniformly onto an endless surface, and wherein said transparentizing step includes applying pressure to the transparentizing material by contacting same with raised portions of a stamping platen.

7. The method of claim 1, wherein said electrostatic depositing step is carried out from one side of the substrate at the predetermined area, and further including another electrostatic depositing step that is carried out from the other side of the substrate at the predetermined area.

8. The method of claim 1, wherein said selecting step includes choosing a transparentizing material that is substantially transparent.

9. The method of claim 1, wherein said selecting step includes choosing a transparentizing material that has a refractive index of between about 1.3 and 1.7.

10. The method of claim 1, wherein said selecting step includes choosing finely divided particles that are dielectric.

11. The method of claim 1, wherein said selecting step includes choosing a transparentizing material that has a refractive index of not more than about $\pm 0.02$ refractive index units different from the refractive index of the substrate.

* * * * *